US005230548A

United States Patent [19]

Southern

[11] Patent Number: 5,230,548

[45] Date of Patent: Jul. 27, 1993

[54] LONGWALL CUTTER DRUM HAVING REDUCED PRODUCTION OF DUST

[76] Inventor: Philip W. Southern, One Lincoln Center, Shinnston, W. Va. 26431

[21] Appl. No.: 933,306

[22] Filed: Aug. 21, 1992

[51] Int. Cl.[5] ..... E21C 25/10

[52] U.S. Cl. ..... 299/86; 299/87; 299/91

[58] Field of Search ..... 299/86, 87, 91, 92, 299/93

[56] References Cited

U.S. PATENT DOCUMENTS

| | | | |
|---|---|---|---|
| 2,650,071 | 3/1950 | Rassieur | 175/404 |
| 3,246,930 | 4/1966 | Krekler | 299/92 |
| 3,397,012 | 8/1968 | Krekeler | 299/86 |
| 3,512,838 | 5/1970 | Kniff | 299/86 |
| 3,747,982 | 7/1973 | Agnew et al. | 299/81 |
| 3,751,114 | 8/1973 | Davis | 299/85 |
| 3,774,324 | 11/1973 | Lafond | 37/142 R |
| 4,143,920 | 3/1979 | Haddock | 299/79 |
| 4,163,581 | 8/1979 | Krekeler | 299/91 |
| 4,268,089 | 5/1981 | Spence et al. | 299/87 |
| 4,453,775 | 6/1984 | Clemmow | 299/81 |
| 4,488,758 | 12/1984 | Clemmow | 299/81 |
| 4,529,250 | 7/1985 | Radford et al. | 299/81 |
| 4,915,454 | 4/1990 | Southern | 299/80 |

FOREIGN PATENT DOCUMENTS

| | | | |
|---|---|---|---|
| 1915152 | 10/1970 | Fed. Rep. of Germany . | |
| 2539707 | 3/1977 | Fed. Rep. of Germany . | |
| 2817726 | 10/1979 | Fed. Rep. of Germany . | |
| 320615 | 11/1971 | U.S.S.R. . | |
| 1184794 | 3/1970 | United Kingdom . | |
| 1284539 | 8/1972 | United Kingdom . | |
| 2008170 | 5/1979 | United Kingdom | 299/91 |

OTHER PUBLICATIONS

Advertisement "Thru-Flush" by Padley and Venables Author and date unknown.

*Primary Examiner*—David J. Bagnell

*Attorney, Agent, or Firm*—Dickinson, Wright, Moon, Van Dusen & Freeman

[57] ABSTRACT

A cutter drum has a sump ring and a plurality of vanes, the exterior surfaces of the sump ring and vanes being substantially smooth. The vanes and sump ring contain holes for receiving cutting bits for cutting material to be mined, the cutting bits being removably mounted in the holes. Retaining blocks are removably mounted in the vanes or sump ring for engaging a base portion of the cutting bit and retaining the cutting bit in the cutting drum.

11 Claims, 2 Drawing Sheets

LONGWALL CUTTER DRUM HAVING REDUCED PRODUCTION OF DUST

TECHNICAL FIELD

This invention relates to the art of mining machines, particularly those used for longwall mining of coal.

BACKGROUND

In the longwall mining of coal, a shearing machine has cutter drum attached to it. The cutter drum is rotated and moved by the shearing machine into the wall by a desired distance depending on the characteristics of the particular coal being mined. The rotating drum is then moved along the wall. As the mined coal falls, it is picked up by a conveyor, which carries it to a location for hauling from the mine.

Cutter drums generally include a hub, which is attached to the shearing machine. The hub carries several helical vanes, and a sump ring is attached to the end of the hub. Cutting bits are attached to the vanes and to the sump ring for engaging and cutting the coal as the cutter drum rotates.

In the typical prior art cutter drum, pockets are flame cut into the vanes to provide seats for bit blocks. The bit blocks are placed in the seats at predetermined angles and then welded to the vanes. Cutting bits are attached to the sump ring in the same fashion.

Another method for attaching bit blocks is to weld the bit block directly to the vanes and the sump ring, without first making a seat, and then bridging the area between adjacent bit blocks with gussets to strengthen the arrangement. In either construction, knock-out holes are generally provided to facilitate removal of a used bit.

These prior art constructions result in cutting drums having very jagged surfaces because the bit blocks and gussets create numerous irregular and uneven surfaces. Falling pieces of coal that have been cut from the coal seam by the cutting bits crash into these jagged and irregular surfaces on the rotating drum. This creates particles of coal and coal dust and distributes them throughout the region surrounding the cutting drum. Such is very dangerous to those working in the mines and reduces the efficiency of the entire longwall mining operation.

SUMMARY OF THE INVENTION

In accordance with the invention, a cutter drum comprises vanes and a sump ring with exterior surfaces that are substantially smooth. The vanes and sump ring provide mounting holes for receiving cutting bits with a minimum of disruption to the smooth surface of the drum. By this construction, the incidence of interaction between the rotating drum and the falling pieces of coal is far less, which greatly reduces the amount of coal particles and coal dust generated in the mining process.

Thus, the working atmosphere is very much improved by the use of the inventive cutting drum, and the longwall apparatus using the new drum requires less energy to operate because the resistance to rotation is less.

The cutting bits are held in the cutting drum by engagement with a retainer block that lies in the vane or sump ring transverse to the cutting bit. The retainer block has a cavity that receives the base end of the cutting bit when the bit is in place in the bit opening. After assembly, the base end of the bit is secured to the cavity in the retainer block by a retaining pin to hold the bit and retaining block in the vane or sump ring. The bit may be removed by removing the retaining pin from the retaining block and lifting the bit from the bit opening. The retaining block may then be removed from the cutting drum.

The gauge of the cutting drum is adjusted by varying the spatial relationship between the cutting bit and the retaining block. This is preferably accomplished by adding or removing washers that lie between the bottom of the cutting bit and the bottom of the cavity in the retaining block. Increasing the number of washers moves the tip of the cutting bit outward, thus increasing the gauge. In the preferred embodiment, the thickness of the washers is about ⅛" to allow fine adjustment of the gauge.

DETAILED DESCRIPTION OF THE PREFERRED EMBODIMENT

Figure 1:
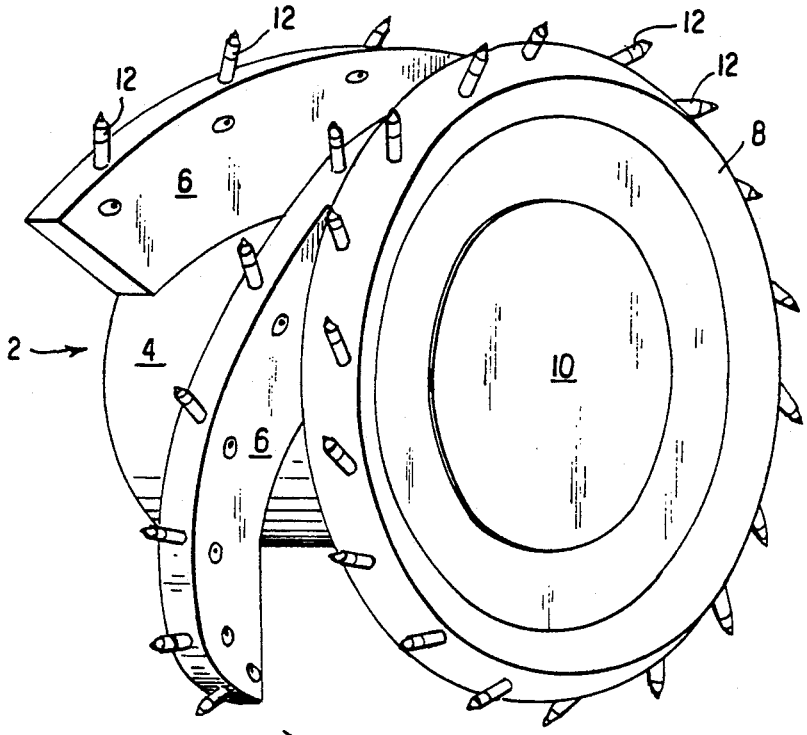
FIG. 1 is a perspective of a cutting drum in accordance with the invention.

With reference to FIG. 1 of the drawings, a cutter drum 2 includes a hub 4, which is designed to be attached to a longwall shearing machine (not shown) in known fashion. Attached to the hub 4 are vanes 6 and a sump ring 8. A plate 10 covers the end of hub 4 and when removed provides access to the interior of the hub for facilitating attachment of the cutter drum to the shearing machine.

Secured to the vanes and the sump ring are a plurality of cutting bits 12, which extend from the vanes at angles appropriate for the cutting of coal. The bits are mounted directly in the vanes and the sump ring in such a manner that the exterior surfaces of the cutter drum are generally smooth. The vanes are helical for carrying cut coal away from the coal face, and the provision of smooth surfaces on the vanes and the sump ring reduces significantly the amount of coal dust and coal particulate produced in the mining operations. Significant amounts of dust and particulate are produced in prior machines by rapidly rotating, roughly surfaced vanes which catch the coal and throw it upward, allowing it to engage the vanes a second time, thus "recycling" the cut coal.

Figure 2:
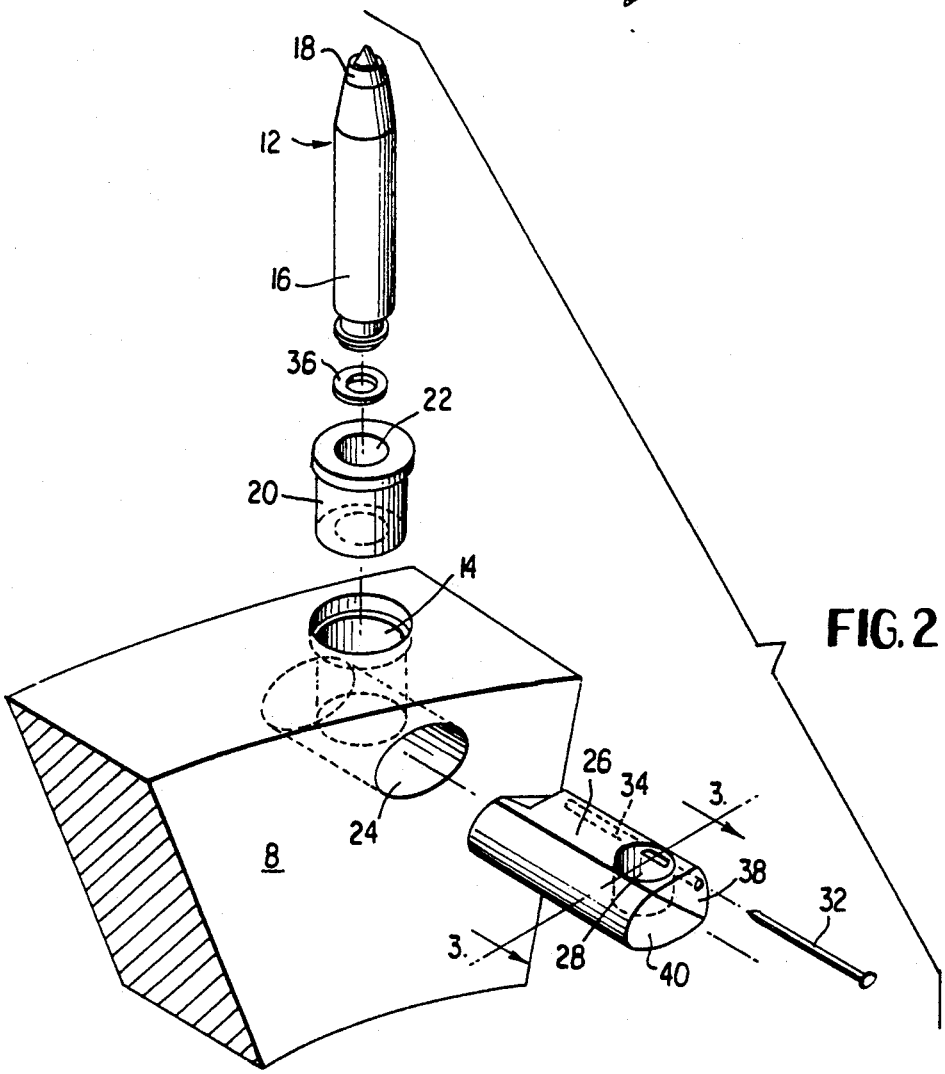
FIG. 2 is an exploded diagram of the sump ring of the cutting drum of FIG. 1 showing the method of attaching the cutting bit to a vane or the sump ring.
Figure 3:
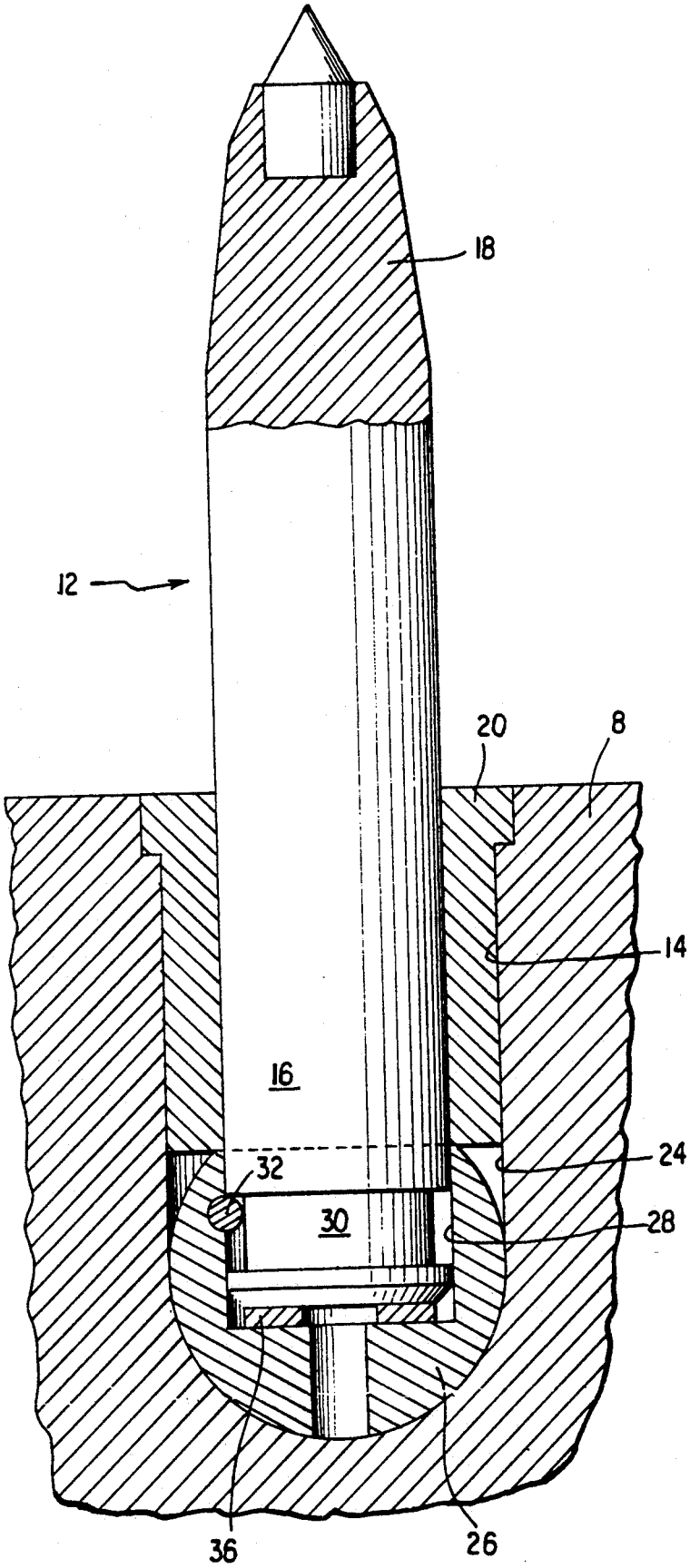
FIG. 3 is a cross section taken along line 3—3 of FIG. 2

The preferred manner in which the cutter bits 12 are secured to the vanes and sump ring is shown in detail in FIGS. 2 and 3, FIG. 2 being an exploded diagram of the attachment of a cutter bit to the sump ring 8, and FIG. 3 being a cross-section taken along line 3—3 of FIG. 2.

With reference to FIGS. 2 and 3, the sump ring 8 has a first opening 14 therein for receiving a base portion 16 of the cutter bit 12, which is remote from a cutting tip 18. A replaceable sleeve 20 is preferably press-fitted into the opening 14 and provides a central hole 22 for directly receiving base portion 16 of the cutter bit.

Sump ring 8 has a second opening 24 therein that extends in a direction transverse to that of first opening 14. First opening 14 is oriented to hold the cutting bit 12 in a direction appropriate for the cutting of coal, taking into consideration the particular location of the cutting bit on the cutting drum. It should also be noted that while the cutting bit shown in FIGS. 2 and 3 extends generally perpendicular to the upper surface of the sump ring, other bits on the cutting drum may be oriented at an angle to the surface of the sump ring or the surface of a vane depending on the requirements of that particular cutting bit.

Second opening 24 receives a retainer block 26, which in turn receives the end of the cutting bit 12 in a cavity 28 when the retaining block is fully inserted into the second opening 24. The end of the cutting bit 12 includes a portion 30 having a reduced diameter that forms a groove for receiving a retaining pin 32. After the sleeve, bit, and retaining block are in place, the retaining pin 32 is inserted into hole 34 in the retaining block 26 to secure the end of the cutting bit to the retaining block. The interaction between the end of the cutting bit and the retaining block secures the retaining block in the sump ring, and the retaining block is held to the sump ring by the interaction between the pin 32 and the end of the cutting bit. Removal of the retaining block after removal of the cutting bit can be accomplished in any of a variety of ways. For example, the block can be pressed out of the vane, or a hole can be provided in the block for insertion of a bolt for allowing the block to be pulled from the vane.

The gauge of the cutting drum can be changed by addition or removal of hardened spacers 36. The addition of spacers increases the gauge by moving the cutting tip 18 outward, while removal of spacers reduces the gauge.

The sleeve and the retaining block receive most of the forces transmitted by the cutting bit. Because these are separate items, they are preferably made of harder material than the vanes or sump ring and are precision machined to desired tolerances. It will be appreciated that the function of the retaining block is similar to known bit blocks, and the retaining block may be referred to herein as a retaining bit block. The faces of the retainer block are machined to provide a surface that is as smooth as possible. In the embodiment shown, leading edge face 38 is angled inward slightly to protect the head of the retaining pin 32. Trailing edge face 40, however, is machined to fit flush with the face of the sump ring to minimize creation of dust and particles.

The holes 14 are preferably drilled into the vanes or sump ring. This allows precise positioning of the cutting bits and results in a better balanced tool which provides smoother operation. This contributes to the reduced production of dust and reduced power requirements. In addition, a cutter drum according to the invention produces less vibration and causes less wear on the gearing of the shearing machine.

It is possible to use cutting bits other than that shown in the drawings. For example, the bit shown in U.S. Pat. Nos. 4,842,337 and 4,915,454 may be used in the new drum. The bits shown in these patents have square bodies and are designed to be held in a particular indexed position. When such a bit is used, a stop is welded to the vane or sump ring to engage the side of the bit and hold it in the desired indexed position.

It is common to provide a water spray system to reduce the dissemination of coal dust. The vanes and sump ring of the inventive drum may also be provided with a system of water passages and spray nozzles, which have not been shown in the drawings, for this purpose.

It will be appreciated that a unique cutter drum and apparatus for attaching a cutting bit to a drum have been described. Modifications within the scope of the appended claims will be apparent to those of skill in the art.

I claim:

1. A cutter drum comprising a sump ring and a plurality of vanes, wherein the exterior surfaces of said sump ring and vanes are substantially smooth and include a first opening extending in a first direction and a second opening at the bottom of said first opening and extending in a direction transverse to said first direction, and further comprising cutting bit means for cutting material to be mined, said cutting bit means being removably mounted in said first opening for orienting said cutting bit means in a predetermined direction, retaining bit block means removably mounted in said second opening for engaging a base portion of said cutting bit means and retaining said cutting bit means in said cutting drum, and means for securing said cutting bit means to said retaining bit block means, wherein opposite ends of said retaining bit block means are configured to combine with the sides of said vane or sump to provide a generally uninterrupted surface when said retaining bit block means engages said base portion of said cutting bit means.

2. A cutter drum according to claim 1 wherein retaining block means comprises an opening for receiving said base and said means for securing said cutting bit to said retaining means comprises means for retaining said base in said opening.

3. A cutter drum according to claim 2 further comprising sleeve means for being received in said cutting drum and for receiving said cutting bit.

4. A cutter drum according to claim 1 further comprising spacer means for adjusting the distance between said retaining bit block means and a cutting tip of said cutting bit.

5. A cutter drum according to claim 4 wherein said spacer means comprises a disc for being placed between said base and the bottom of said opening.

6. In combination, cutting bit means for cutting material to be mined, retaining bit block means for retaining said cutting bit means in a cutting drum, and means for securing said retaining bit block means to said cutting bit means, wherein said cutting bit means comprises a base, a cutting tip remote from said base, and a portion intermediate said base and tip for being received in said cutting drum for at least partially maintaining alignment of said cutting bit means, and said retaining bit block means comprises means for being removably received in said cutting drum and, when in operative position in said cutting drum, engaging said base and being secured to said bit by said means for securing, for retaining said cutting bit means and said retaining bit block means in said cutting drum.

7. A combination according to claim 6 wherein said means for engaging said base comprises and opening for receiving said base and said means for securing comprises means for retaining said base in said opening.

8. A combination according to claim 7 further comprising sleeve means for being received in said cutting drum and for receiving said cutting bit.

9. A combination according to claim 7 further comprising spacer means for adjusting the distance between said retaining block means and said cutting tip.

10. A combination according to claim 9 wherein said spacer means comprises a disc for being placed between said base and the bottom of said opening.

11. A combination according to claim 6 wherein said retaining bit block means is made of hardened material and supports said cutting bit means against forces on said cutting bit means created by said mining of material.

* * * * *